United States Patent [19]

Wood et al.

[11] Patent Number: 4,777,791

[45] Date of Patent: Oct. 18, 1988

[54] METHOD OF SHUTTING DOWN A ROTOR SPINNING MACHINE

[75] Inventors: Alfred Wood, Greater Manchester; John Rothwell, Lancashire, both of England

[73] Assignee: Hollingsworth U.K. Ltd., Accrington, England

[21] Appl. No.: 128,754

[22] Filed: Dec. 2, 1987

[30] Foreign Application Priority Data

Dec. 4, 1986 [GB] United Kingdom ..... 8628996

[51] Int. Cl.[4] ..... D01H 1/20; D01H 1/28; D01H 15/00

[52] U.S. Cl. ..... 57/263; 57/264; 57/81

[58] Field of Search ..... 57/261, 263, 264, 301, 57/400, 401, 78, 81

[56] References Cited

U.S. PATENT DOCUMENTS

| | | | |
|---|---|---|---|
| 4,228,642 | 10/1980 | Dakin et al. | 57/263 |
| 4,246,748 | 1/1981 | Artzt et al. | 57/264 X |
| 4,338,777 | 7/1982 | Suzuki et al. | 57/78 X |
| 4,563,873 | 1/1986 | Tooka | 57/264 |
| 4,586,325 | 5/1986 | Wassenhoven | 57/263 |

*Primary Examiner*—Donald Watkins
*Attorney, Agent, or Firm*—Cort Flint

[57] ABSTRACT

The invention provides for the spinning units of a multi-position rotor spinning machine to be driven by a common AC drive motor powered by a static inverter enabling the power supply frequency to the AC motor to be controlled for controlling the rate of acceleration and the operating speed and the rate of deceleration of the AC drive motor. This facilitates a method of mass stopping.

7 Claims, 1 Drawing Sheet

METHOD OF SHUTTING DOWN A ROTOR SPINNING MACHINE

FIELD OF THE INVENTION

The present invention relates to a method of starting a multi-position spinning machine having several rotor spinning units driven so that each takes in a fibrous sliver and delivers spun yarn wound on a bobbin.

PRIOR ART

It is known to carry out the piecing operation on starting-up an rotor spinning unit by allowing the spinning unit to accelerate from rest, monitoring the acceleration of the spinning unit, and then introducing the seed yarn to the spinning location at a desired speed of the spinning unit. For example, this may comprise introducing the seed yarn to the fibre-receiving groove in the rotor of a rotor spinner when the rotor has achieved a desired rotation rate during its acceleration from rest.

The acceleration of the rotor normally depends upon the load characteristic of the motor, and on the drag of the transmission system and the motor which may vary with climatic parameters such as temperature and humidity. The drive transmission may be, for example, a flat belt drive running the full length of the machine and driven by a motor at one of the gearing ends of the machine.

SUMMARY OF THE INVENTION

Accordingly the present invention provides a method of shutting down a multi-position rotor spinning machine comprising progressively reducing the input frequency to AC drive means powering the various spinning units to a predetermined reduced operating speed; on attainment of said predetermined reduced operating speed, deflecting the yarn delivery path to a tortuous configuration in which a yarn reserve loop is formed; stopping sliver feed to the various rotor spinning units; measuring the rotation of the yarn delivery rollers after the instant of stopping sliver feed to determine the length of yarn delivered: and braking the yarn delivery rollers to a standstill once a predetermined yarn length has been delivered following the stopping of the sliver feed.

Said AC drive means may be a common AC electric motor powered by way of an inverter generating a variable output frequency for driving said AC motor at variable speed.

Advantageously the type of inverter used is a static inverter using solid state switching to generate the desired output frequency adjustable at will.

BRIEF DESCRIPTION OF THE DRAWINGS

In order that the present invention may more readily be understood the following description is given, merely by way of example, with reference to the accompanying drawing in which.

DESCRIPTION OF THE PREFERRED EMBODIMENT

Figure 1:
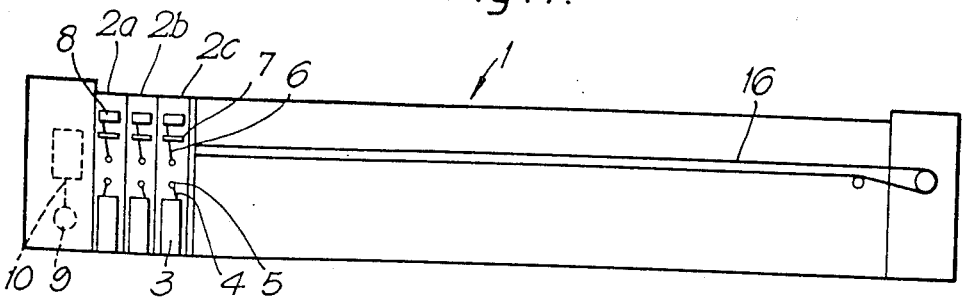
FIG. 1 is a front elevational view of a of multi-position rotor spinner in accordance with the present invention.

Referring now to the drawing, FIG. 1 shows a machine 1 having a plurality of rotor spinning units 2*a*, 2*b*, 2*c*, etc., along each side of the machine.

Each of the rotor spinning units includes a sliver can 3 from which a sliver 4 emerges and enters a sliver inlet aperture 5 to the beater or fibre-opening unit. The spun yarn 6 leaving the doffing tube of the spinning unit passes between delivery rollers 7 and on to a winding package 8 along which it is traversed by conventional traverse means (not shown).

In the embodiment of FIG. 1, the rotor spinning unit incorporates a conventional rotor having an internal fibre-receiving groove into which the separated fibres from the beater are introduced while airborne in a transporting airstream, and the fibres become rolled up in the rotor to form the spun yarn 6 which is subsequently wound onto the package 8.

The embodiment of FIG. 1 shows an AC motor 9 at the left hand gearing end of the machine driving a main transmission 10. This transmission 10 is shown in FIG. 2 where the motor 9 is also illustrated.

This drawing shows a typical fibre-opening roller or beater 11 of the first spinning unit 2*a*, driven, along with all the other beaters of the other spinning units 2*b*, 2*c* . . . etc., by a flat belt 12 extending along the length of the machine. The corresponding flat belt 12' driving the beaters at the far side of the machine (behind the row of spinning units on the side shown in FIG. 1) is shown at 12', as are the linking transmission components therebetween.

Figure 2:
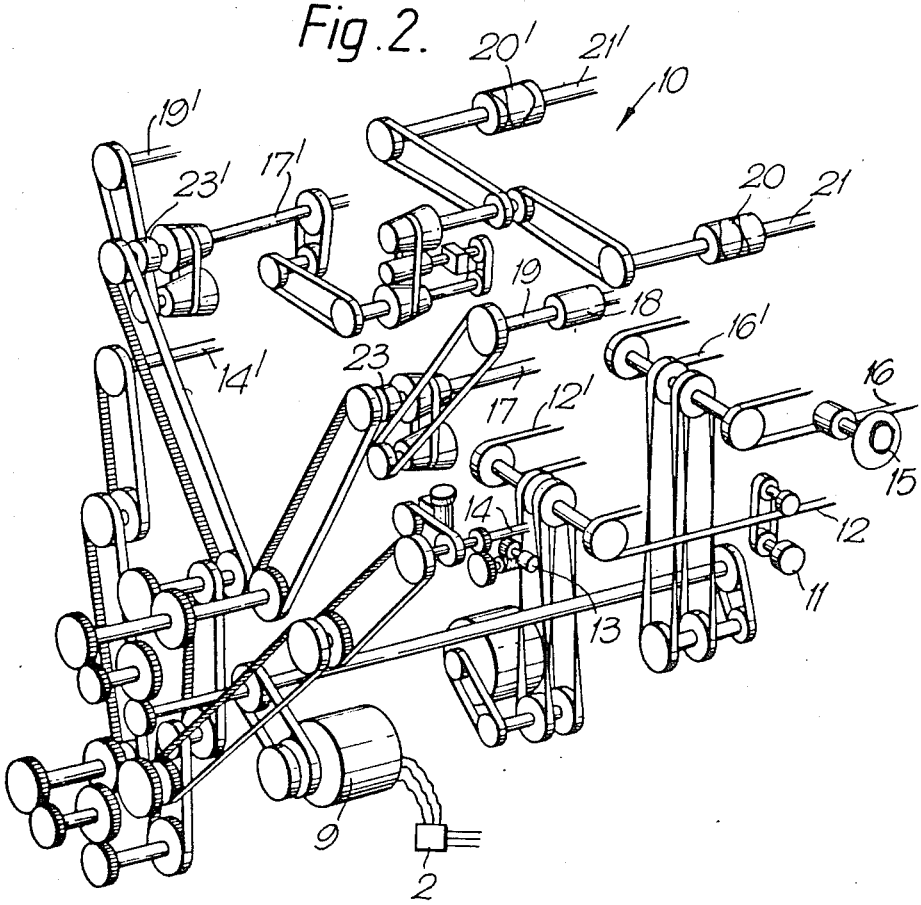
FIG. 2 is a perspective of the drive transmission components in the gearing end of the rotor spinning machine shown in FIG. 1.

FIG. 2 also shows a sliver feed roller 13, displaced in position (to facilitate illustration) since it would normally be very closely adjacent the beater 11, and the drive shaft linking the various sliver feed rollers 13 can be seen at 14. Again, the corresponding sliver feed roller drive shaft 14' to the row of spinning units on the far side can be seen in FIG. 2.

The drive to the various spinning rotors 15 comprises a flat belt 16 for those at the near side of the machine, and a similar flat belt 16' to those at the far side of the machine.

The yarns spun by rotation of the rotors 15, when fibres separated by means of the beaters 11 are injected thereto, are delivered by means of the delivery rollers 7 (not shown in FIG. 2) along a shaft 17 for the set of spinning units on the near side. The corresponding delivery roller shaft 17' can be seen for the spinning units along the far side of the machine. The shafts 17, 17' are controlled by respective clutches 23, 23'.

The yarns from the delivery rollers 7 are then fed to rotating packages 8 driven by package drive rollers 18 of which the first such roller, for the spinning unit 2*a* on the near side of the machine, can be seen in FIG. 2. The drive shaft 19 for the package drive rollers along the near side of the machine and the corresponding drive shaft 19' for those along the far side of the machine can also be seen in FIG. 2.

In order to form the appropriate helical build-up of yarn on the core supporting the package, the yarn is traversed axially along the package, in a conventional way, by traversing drums 20 having endless helical grooves which drive traverse guides, not shown, and which are mounted on the drive shaft 21 extending along the near side of the machine. One of the traversing drums 20' along the far side of the machine and the corresponding drive shaft 21' for all of those traversing drums are also shown in FIG. 2.

In accordance with the present invention, the AC drive motor 9 is controlled at a varying speed by means of a varying frequency input, in this case derived from a static inverter. It is therefore possible to control precisely the speed of rotation of all of the various functions of the machine simply by changing the input frequency to the AC motor 9. Reducing the input frequency will thus slow down the sliver feed rollers 13, the beaters 11, the rotors 15, the delivery rollers along the shaft 17, the package drive rollers 18, and the traverse drums 20 along the near side of the machine so that all of the spinning units slow down or speed up in synchronism.

This ability to vary the speed of all of the functions simultaneously along the whole length of the machine has several advantages. It is particularly convenient for the facility to be incorporated in conjunction with some angular velocity sensor associated with the motor 9, or with one of the components driven thereby, so that an identical acceleration and deceleration programme can be followed every time the machine is started up or shut down.

For example, it is known that when powering a multi-position rotor spinning machine using a three phase AC motor, the motor control circuit employs star winding for the first part of the acceleration phase when high torque is not needed and the winding is converted to delta winding at a particular stage later during the acceleration when the higher drive torque is required. It has been known for the sudden increase in speed through the transfer from star winding to delta winding to result in instability of endless belt drives resulting in shedding of one or more of the belts and the need for a shut down, reinstatement of the appropriate belt drive, and a subsequent attempt to start-up. By having a smoothly changing input frequency to the motor 9 it is possible to avoid the effects of the sudden transition from star winding to delta winding.

A further disadvantage of prior art systems where free acceleration and deceleration of the drive motor is available can be that under certain climatic conditions (for example different humidity conditions or different temperatures), the bearing drag and belt drag experienced by the motor may result in either a faster than usual acceleration or a slower than usual acceleration, and the same differences can occur on deceleration.

Knowing the need for careful matching of the various speeds of the functions of an rotor spinning unit to avoid yarn break during acceleration, it is important to know that the optimum acceleration rate can be achieved every time, regardless of bearing load and other loads which may vary as a result of climatic or other external influences, and thus the use of an inverter to energise the main drive motor of the machine offers considerable advance.

The fact that each rotor spinning unit such as 2*a* has all its drive components powered from the same drive motor, as shown in FIG. 2, ensures that the rate of rotation of the beater provides separated fibres at a supply rate which is matched to the speed of rotation of the rotor 15, and also ensures that the delivery rollers 7 and the package 8 are rotated at rates which are consistent with the rate of rotation of the rotors 15 in order to ensure uniform twist per unit length of the spun yarn even during the piecing cycle.

However, although only one embodiment is specifically illustrated in the drawings there are various other possibilities for the simultaneous driving of all of the various spinning units with control of the speeds of the individual functions, but without the use of one drive motor for all functions. For example, the drive shafts 14, 14' to the sliver feed rollers of the multi-position rotor spinning machine may be by way of a separate motor which has its own static inverter frequency controller so that the slower speed of operation of the sliver feed rollers 13 can be met without the need for a cumbersome step-down transmission from the main drive powering the faster-moving beaters 11, rotors 15, delivery rollers shafts 17, package drive rollers 18 and traversing drums 20. Equally, one or more of these various functions may have a separate drive motor other than the main motor 9, with all of the functions of the machine being controlled by means of variation of the supply frequency to the respective drive motors for those functions.

As indicated above, the acceleration rate of the drive motor 9 (and, where appropriate, the other drive motors which may drive individual sub-functions of the machine) is predetermined to give optimum but reproducible acceleration and deceleration rates. For example, the programme may be such as to carry out a mass start-up with simultaneous piecing of all of the units, for example by means of the mechanism disclosed and claimed in GB-A-No. 2032967.

The use of such a reproducible cycle is particularly advantageous in that the speed of rotation of the drive motor during its acceleration cycle can be precisely controlled, and hence there is no longer the need to monitor the rate of rotation of the rotor when deciding the correct instant for insertion of the seed yarn; instead, the speed of the rotor can be itself controlled to achieve the desired rate of rotation of the rotor at the instant when the insertion of the seed yarn into the fibre-receiving groove of the rotor is to take place. This selection of the speed of the rotors is of course controlled by virtue of the programmer (not shown) which drives the inverter 22.

The control circuitry of the static inverter 22 for the AC drive motor 9 of FIGS. 1 and 2 need not be described in detail herein as it is conventional and would be readily apparent to one skilled in the art.

The improvement afforded by the present invention is in the use of an AC motor which is not mains-synchronous but is able to be controlled in a precise manner in order to allow the operating parameters of the rotor spinning units to be optimized. The motor may if desired, be polyphase with one inverter per phase.

A further advantage of the use of an inverter in the embodiment described is that it is possible for precise control and management of the spinning parameters at all times because the speed of rotation of the operating parts of the machine can be dictated rather than monitored and followed.

As an example of the advantage of using precise control of the motor speed by means of an inverter-controlled AC motor, there now follows a description of a typical stopping sequence which is possible in accordance with the present invention.

Firstly the speed of operation of the 3-phase AC motor 9 is reduced at a controlled rate by progressively reducing its supply frequency down to a reduced speed which applies to all functions of the individual spinning units. In the alternative embodiment where different AC motors are used for one or more of the different functions along a set of spinning units, the various motors would be run down in synchronism.

The value of this reduced operating speed is chosen to be one from which the delivery rollers can be rapidly braked once a "stop" signal has been given. Once this reduced speed has been achieved, the looping bar is traversed to deflect the yarn path from a normal relatively straight "spinning" configuration to a reserve-forming tortuous configuration in order to form a reserve of yarn which can readily be fed back for subsequent piecing on start-up. Such a looping bar is illustrated at 48 in the drawing of our GB-A-No. 2032967 the disclosure of which is incorporated herein by reference.

At this stage the yarn reserve has been formed and the sliver feed is immediately arrested by stopping the sliver feed roller drive shafts 14, 14' by means of a clutch/brake device, not shown.

Immediately the "stop sliver feed" signal has been given, a counting circuit counts rotation of the delivery rollers, by means of a suitable pulse generator associated with the drive shafts 17, 17' for the delivery rollers. Once the counted rotation is equivalent to a predetermined value which corresponds to the substantial spinning out of fibres from the rotor, a signal is given to declutch the delivery roller shafts 17, 17' at 23, 23' and to brake them, thereby arresting the delivery rollers 7 substantially instantaneously so that the spun out end of the yarn remains in the doffing tube. The existence of the yarn reserve between the delivery rollers 7 and the package 8 is maintained at this time through retention of the looping bar in its position into which it moved upon attainment of the reduced operating speed at the start of the shut-down sequence.

The stopping of the delivery rollers 7 represents the final stage of the shut-down procedure and leaves all of the yarn ends held ready for start-up.

When all spinning positions are shut down simultaneously for any reason during daytime, i.e. when resumption of operation during the same working shift is required, the suction will remain in operation and hence the yarn ends will be sure to remain in the doffing tubes, as a result of the procedure which has just been described. However, if the shut-down is to involve a prolonged period of down time, for example on overnight shut-down, the suction will be switched off and as a result there is no longer any guarantee that the yarn ends remain in the doffing tubes. There is then an alternative sequence in which, during the final running down phase of the spinning units the looping bar, which has already formed the yarn reserve adequate to allow the yarn end to remain in the doffing tube while the yarn reserve is maintained between the doffing tube and the delivery roller nip, is returned to its normal spinning or "park" position to allow the yarn end to be dragged still further down the doffing tube and to re-enter the spinning chamber after the machine has stopped. This is achieved at a predetermined suction level low enough to prevent snarling of the yarn end when re-inserted in the doffing tube.

On start-up after such an overnight shut-down, the main suction is first of all re-energized and at a predetermined suction level the looping bar is traversed to its fully extended position in which it once again holds back a reserve of yarn between the doffing tube and the delivery roller nip. At this point the tip of the yarn is correctly positioned in the doffing tube ready for re-introduction when the spinning unit has achieved piecing speed, by the looping bar returning to its parked position to re-insert the yarn.

Such a system is important in a rotor spinner. The precise length of yarn available for feeding back into the rotor, in order to contact the ring of fibres which is fed to the rotor upon start-up, and maintenance of the yarn tip in the doffing tube are ensured by virtue of the action of the looping bar and of the counted rotation of the delivery rollers between the "stop sliver feed" signal and the "brake delivery rollers" signal on the shut-down sequence.

Although an alternative process could involve counting a given time delay between the "stop sliver feed" and "brake delivery rollers" signals, the time in question will vary from one yarn count value to another and will depend on rotor rotation speed, and it is therefore advantageous to be able to count the rotation of the delivery rollers so that irespective of the yarn count value the length of yarn held in reserve will always be predetermined. It is therefore important to stop the sliver feed at a known operating speed.

For piecing after a yarn break, some or all of the various functions (sliver feed, beater rotation, rotor rotation, delivery roller rotation, package rotation, and yarn, traversing) for each individual spinning unit are all able to be declutched or otherwise disengaged from their respective drive elements 14 and 14', 12 and 12', 16 and 16', 17 and 17', 19 and 19', and 21 and 21' extending along the machine to link the various spinning units together in normal spinning operation and on mass start-up and shut-down.

We claim:

1. A method of shutting down a multi-position rotor spinning machine comprising progressively reducing the input frequency to AC drive means powering the various spinning units to a predetermined reduced operating speed; and on attainment of said predetermined reduced operating speed, stopping sliver feed to the various rotor spinning units; measuring the rotation of the yarn delivery rollers after the instant of stopping sliver feed to determine the length of yarn delivered; and braking the yarn delivery rollers to a standstill once a predetermined yarn length has been delivered following the stopping of the sliver feed; and including the step of deflecting the yarn delivery path to a tortuous configuration in which a yarn reserve loop is formed.

2. A method according to claim 1, wherein the transmissions for the sliver feed means, the fibre opening rollers, the spinning rotors, the yarn delivery rollers, the package friction drive rolls of the package winders and the yarn traverse guide means of the package winders are common to all the various spinning units along the multi-position rotor spinning machine and are driven by at least one common AC drive motor.

3. A method according to claim 2, wherein the transmission to the various sliver feed rollers has its own respective AC drive motor of controlled input frequency.

4. A method according to claim 1, wherein the various rotor spinning units along the multi-position rotor spinning machine have their own respective AC drive motor.

5. A method according to claim 1, wherein the input frequency to said AC drive means is by way of at least one static inverter.

6. A method according to claim 5, wherein said AC drive means is poly-phase and there are several static inverters, each associated with a respective one of said phases.

7. A method according to claim 1 including deflecting the yarn delivery path to a tortuous configuration in which a yarn reserve loop is formed upon attainment of said predetermined reduced operating speed.

* * * * *